United States Patent [19]

Schedele

[11] Patent Number: 4,523,165

[45] Date of Patent: Jun. 11, 1985

[54] CONTACT ARRANGEMENT FOR RELAYS

[75] Inventor: Helmut Schedele, Diessen, Fed. Rep. of Germany

[73] Assignee: Siemens Aktiengesellschaft, Berlin & Munich, Fed. Rep. of Germany

[21] Appl. No.: 485,401

[22] Filed: Apr. 15, 1983

[30] Foreign Application Priority Data

May 10, 1982 [DE] Fed. Rep. of Germany ..... 3217528

[51] Int. Cl.[3] ..... H01H 67/00

[52] U.S. Cl. ..... 335/106; 335/133; 200/16 A

[58] Field of Search ..... 335/106, 107, 133, 135, 335/156, 201, 129; 200/16 A, 243

[56] References Cited

U.S. PATENT DOCUMENTS

| | | | |
|---|---|---|---|
| 1,862,158 | 6/1932 | O'Keeffe | 335/129 |
| 1,878,657 | 9/1932 | Ainsworth | 335/201 |
| 2,834,848 | 5/1958 | Ellwood | 335/133 |
| 2,900,470 | 8/1959 | Egerer | 200/16 A |

*Primary Examiner*—E. A. Goldberg
*Assistant Examiner*—George Andrews
*Attorney, Agent, or Firm*—Hill, Van Santen, Steadman & Simpson

[57] ABSTRACT

A contact arrangement encompasses at least two stationary and at least two movable contact elements actuatable in common, whereby all contact elements can be connected in series over bridge contact elements which reside opposite one another and which are mutually offset. A multiplication of the contact spacing and an increase of the making and/or breaking capacity of the relay is therefore provided.

2 Claims, 5 Drawing Figures

CONTACT ARRANGEMENT FOR RELAYS

BACKGROUND OF THE INVENTION

1. Field of the Invention

The present invention relates to a contact arrangement for relays having stationary and movable contact elements residing opposite one another, whereby two contact elements disposed next to one another can be electrically bridged by a bridge contact element residing opposite thereto.

2. Description of the Prior Art

Bridge arrangements of the general type set forth above have been well known in contactors and in relays. With a contact spacing, they serve the purpose of being able to reliably switch even high currents on and off. These known contact arrangements exhibit a movable bridge contact element which bridges the two stationary contact elements respectively provided with a terminal and residing opposite one another.

In individual cases, such bridge contacts are already being employed in small weak current relays in order to be able to switch high currents even given the relatively small armature stroke and the small contact spacing connected therewith. In the course of further miniaturization, however, the magnet system and the armature paths are to be further reduced. Simultaneously, however, a requirement is raised that such small relays should also be employed for switching in heavy current systems.

SUMMARY OF THE INVENTION

It is therefore the object of the present invention to provide a contact arrangement which can also switch high currents given a low contact spacing or, respectively, armature stroke.

The above object is achieved, according to the present invention, given a contact arrangement of the type generally set forth above in that at least two stationary contact elements reside opposite at least two movable contact elements which are actuatable in common, of which at least one is designed as a bridge contact element and which are disposed offset relative to one another such that, upon actuation, the stationary and the movable contact elements can all be switched in series.

Given a contact arrangement constructed in accordance with the present invention, therefore, it is not only one movable bridge contact which is employed but, rather, at least one further contact element actuatable together with the bridge contact is provided in addition to the bridge contact, the additional contact element, in conjunction with at least one stationary bridge contact element residing opposite thereto, producing a series connection of at least three contact spacings. The manner of operation of at least three times the contact spacing thereby derives in comparison to a single contact. By adding one or more further contact bridges in a respectively offset, opposing disposition, the series connection of four or more contact spacings can also be achieved.

The stationary or movable contact elements disposed next to one another which, under certain conditions, are to be actuated in common, are advantageously connected to one another over a respective insulating material cladding. Thereby, one of these contact elements can be chucked in a relay housing as an elongate spring element, whereas the further contact element actuatable in common therewith is carried by this contact element and is secured thereto over an insulating material cladding. The connection can occur over a torsion member so that a tolerance balancing during switching and, therefore, a fault-free contacting are achieved.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
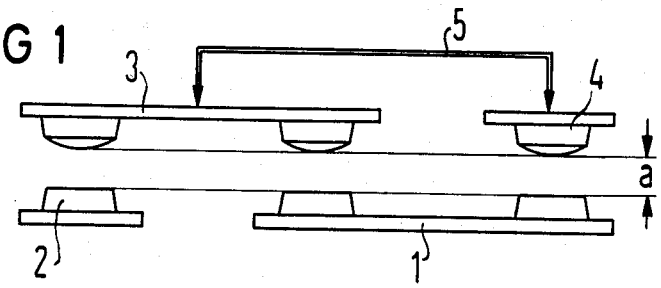
FIG. 1 illustrates a contact arrangement having two contact bridges and two single contact elements.

Referring to FIG. 1, a contact arrangement is schematically illustrated as having a stationary contact bridge 1 and a single contact element 2 adjacent thereto, the single contact element 2 exhibiting, respectively offset, a movable contact bridge 3 and a movable single contact element 4 disposed adjacent thereto. The single contact elements 2 and 4 are provided with leads (not illustrated). The movable contact elements 3 and 4 are actuated in common by a schematically illustrated actuation element 5, whereby all four contact elements can be switched into a series connection 2, 3, 1, 4. The contact spacing a is switched three times in succession by so doing, so that the effect of a contact spacing of (*3a*) derives between the contact elements 2 and 4.

Figure 2:
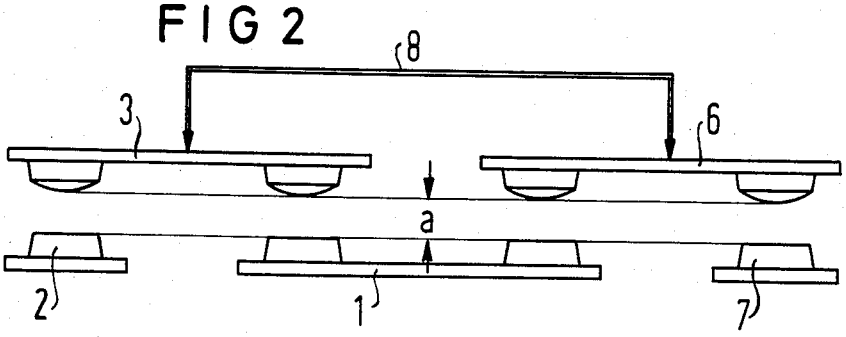
FIG. 2 illustrates a contact arrangement having three contact bridges and two single contact elements.

A corresponding contact arrangement with an effective contact spacing of (*4a*) is illustrated in FIG. 2. In addition to the two contact bridges 1 and 3, a further contact bridge 6 is provided, this additionally having a single contact element 7 lying opposite thereto. By way of an actuation member 8, the two contact bridges 3 and 6 are actuated in common, whereby all contact spacings are again switched and the contact elements form a series connection 2, 3, 1, 6, 7.

Figure 3:
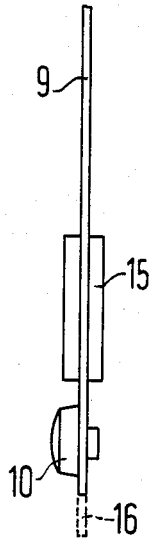
FIG. 3 is a side view of a contact bridge with a single contact element.
Figure 4:
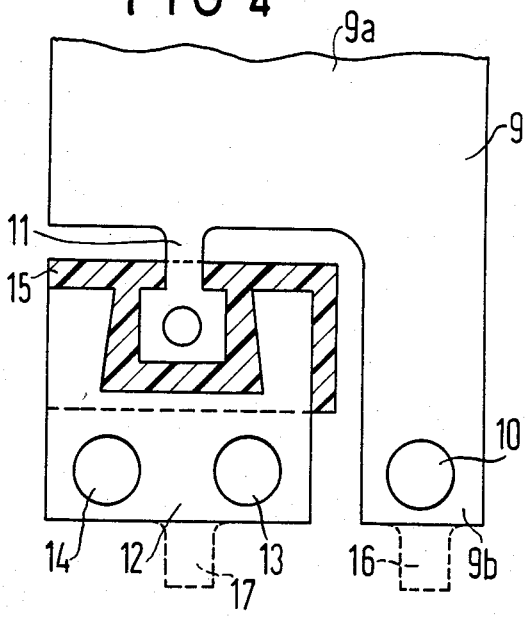
FIG. 4 is a plan view of the structure of FIG. 3 illustrating the contact bridge and single contact.

Referring to FIGS. 3 and 4, an embodiment of a combined contact element having a single contact and a bridge contact disposed adjacent thereto is illustrated. The contact element 9 is secured at its base in a manner not illustrated and carries a contact rivet 10 at its free end 9*b*. Over a narrow stay 11, the contact spring 9 carries an additional bridge contact element 12 whose two contact rivets 13 and 14 lie in a row aligned with the contact rivet 10. The bridge contact 12 is secured to the stay or torsion member 11 by a partial extrusion-coating of insulating material 15. When switching, the member 11 can be twisted for compensation so that a fault-free contacting of all three contact rivets 10, 13 and 14 is always achieved. The multiple contact element 9 and 12 can therefore by employed both as a stationary contact element as well as a movable contact element. In the latter case, two actuation tabs 16 and 17 may be integrated at the free ends in order to facilitate the attack of an armature over a slide. In another embodiment, however, a bridge contact spring and a single contact spring can be separately anchored adjacent one another in a spring clamping lug.

Figure 5:
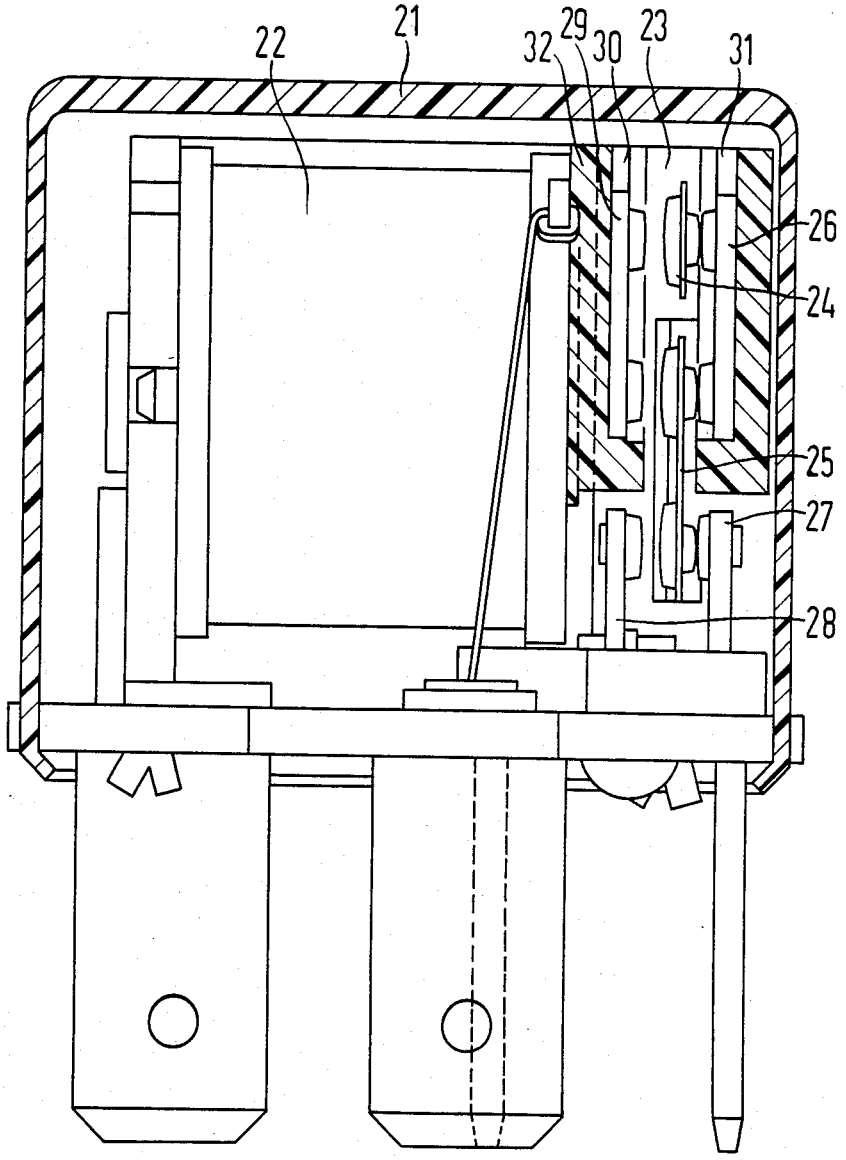
FIG. 5 is a sectional view of a relay constructed with contacts in accordance with the present invention.

FIG. 5 illustrates the application of a contact structure of the present invention, particularly that of FIG. 1, to a transfer contact arrangement in a relay. The relay housing 21 contains a standard magnet system 22 having an armature 23 which is visible only by way of indication. The armature actuates a center contact spring arrangement which comprises a single contact element 24 and a bridge contact element 25 which can be switched between two stationary contact element pairs. These stationary contact elements comprise a bridge contact element 26 and a single contact element 27 at the home side, as well as a single contact element 28 and a bridge contact element 29 at the operating side. The stationary contact elements 27 and 28, as well as the movable contact element 24 are respectively provided with a terminal. The bridge contact elements 26 and 29 are thereby pressed in a gripping manner into guide grooves 30 or, respectively, 31, of the coil body flange 32. So that the contacts come to lie at the same height, it can be expedient to fit the contact elements 27 and 28 into guide grooves of the coil body flange 32 in a manner not illustrated in detail. The adjustment expense can thereby be reduced.

As explained above on the basis of the preceding figures, the movable contact elements 24 and 25 are actuated in common so that the contact spacing is again connected in series three times, whereby the mating and/or breaking capacity of the relay can be significantly increased in comparison to a single contact as well as in comparison to a traditional bridge contact. According to the invention, therefore, the contact spacing can respectively by multiply switched to provide a series connection or connections without the necessity of terminals being respectively conducted out from each contact element and requiring connection in series in terms of circuit technology.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A relay comprising:

housing means;

an electromagnet carried by said housing means including a coil body flange having grooves therein and an armature;

a pair of stationary bridging contacts fixedly mounted spaced from one another in respective ones of said grooves;

a pair of stationary contacts mounted in said housing means spaced from one another; and an additional single contact and an additional bridging contact coupled to said armature and mounted between said fixedly mounted contacts as transfer contacts and so positioned to provide a series circuit connection of contacts in either operative state of said relay.

2. A relay contact arrangement comprising:

first, second and third stationary contacts mounted coplanar with respect to one another;

a first electrically-conductive bridge connecting said first and second contact;

fourth, fifth, and sixth movable contacts mounted coplanar with respect to one another with said fourth contact opposite and facing said third contact, said fifth contact opposite and facing said second contact and said sixth contact opposite and facing said first contact; and a base including a section carrying and electrically contacting said sixth contact, a second electrically-conductive bridge connecting said fourth and fifth contacts, and connection means including an insulator mechanically connecting said second electrically conductive bridge to said base, said connection means comprising a web section projecting from said base and connected to said insulator and serving as a torsion member.

* * * * *